US011161111B2

(12) United States Patent
Kabaha et al.

(10) Patent No.: US 11,161,111 B2
(45) Date of Patent: Nov. 2, 2021

(54) MULTILEVEL DISPOSABLE CARTRIDGE FOR BIOLOGICAL SPECIMENS

(71) Applicant: Miltenyi Biotec GmbH, Bergisch Gladbach (DE)

(72) Inventors: Eiad Kabaha, Bonn (DE); Stefan Miltenyi, Bergische Gladbach (DE); Frederik Fritzsch, Cologne (DE); Ralf-Peter Peters, Bergisch Gladbach (DE)

(73) Assignee: Miltenyi Biotec B. V. & Co. KG, Bergisch Gladbach (DE)

( * ) Notice: Subject to any disclaimer, the term of this patent is extended or adjusted under 35 U.S.C. 154(b) by 262 days.

(21) Appl. No.: 16/301,115

(22) PCT Filed: Jun. 19, 2017

(86) PCT No.: PCT/EP2017/064886
§ 371 (c)(1),
(2) Date: Nov. 13, 2018

(87) PCT Pub. No.: WO2018/001767
PCT Pub. Date: Jan. 4, 2018

(65) Prior Publication Data

US 2019/0126274 A1 May 2, 2019

Related U.S. Application Data

(60) Provisional application No. 62/356,310, filed on Jun. 29, 2016.

(51) Int. Cl.
*B01L 3/00* (2006.01)

(52) U.S. Cl.
CPC ..... *B01L 3/502746* (2013.01); *B01L 3/50273* (2013.01); *B01L 3/502738* (2013.01); *B01L 2200/16* (2013.01); *B01L 2300/0816* (2013.01); *B01L 2300/0867* (2013.01); *B01L 2300/0887* (2013.01); *B01L 2300/123* (2013.01); *B01L 2400/049* (2013.01);
(Continued)

(58) Field of Classification Search
CPC combination set(s) only.
See application file for complete search history.

(56) References Cited

U.S. PATENT DOCUMENTS 6,355,134 B1 * 3/2002 Berndt ..... B01D 19/0031 156/311
7,741,045 B2 6/2010 Gerdes et al.
(Continued)

FOREIGN PATENT DOCUMENTS

EP 0810428 5/1997

*Primary Examiner* — Samuel P Siefke
*Assistant Examiner* — Tingchen Shi
(74) *Attorney, Agent, or Firm* — Jacquelin K. Spong

(57) ABSTRACT

A multilevel, disposable cartridge may have a plurality of fluid wells or reservoirs holding a plurality of reagents, and a sample viewing area to view a biological sample. The reagents may be applied sequentially to the sample by opening a specific valve formed in an elastomeric, flexible layer under the fluid well. The fluid channels may be formed in a first rigid plastic layer to conduct the reagent to the sample. Pneumatic channels for applying suction or pressure to the valves may be formed in a second rigid, plastic layer.

17 Claims, 14 Drawing Sheets

(52) U.S. Cl.
CPC ..... *B01L 2400/0481* (2013.01); *B01L 2400/0487* (2013.01); *B01L 2400/0655* (2013.01); *B01L 2400/086* (2013.01)

(56) References Cited

U.S. PATENT DOCUMENTS

2003/0224531 A1* 12/2003 Brennen ..... B01L 3/5025 436/180
2004/0063217 A1* 4/2004 Webster ..... B01L 3/502738 436/180
2008/0264863 A1* 10/2008 Quake ..... F16K 99/0026 210/651
2009/0023608 A1* 1/2009 Hung ..... B01L 3/502761 506/32
2012/0128549 A1* 5/2012 Zhou ..... B01L 3/502738 422/504

* cited by examiner

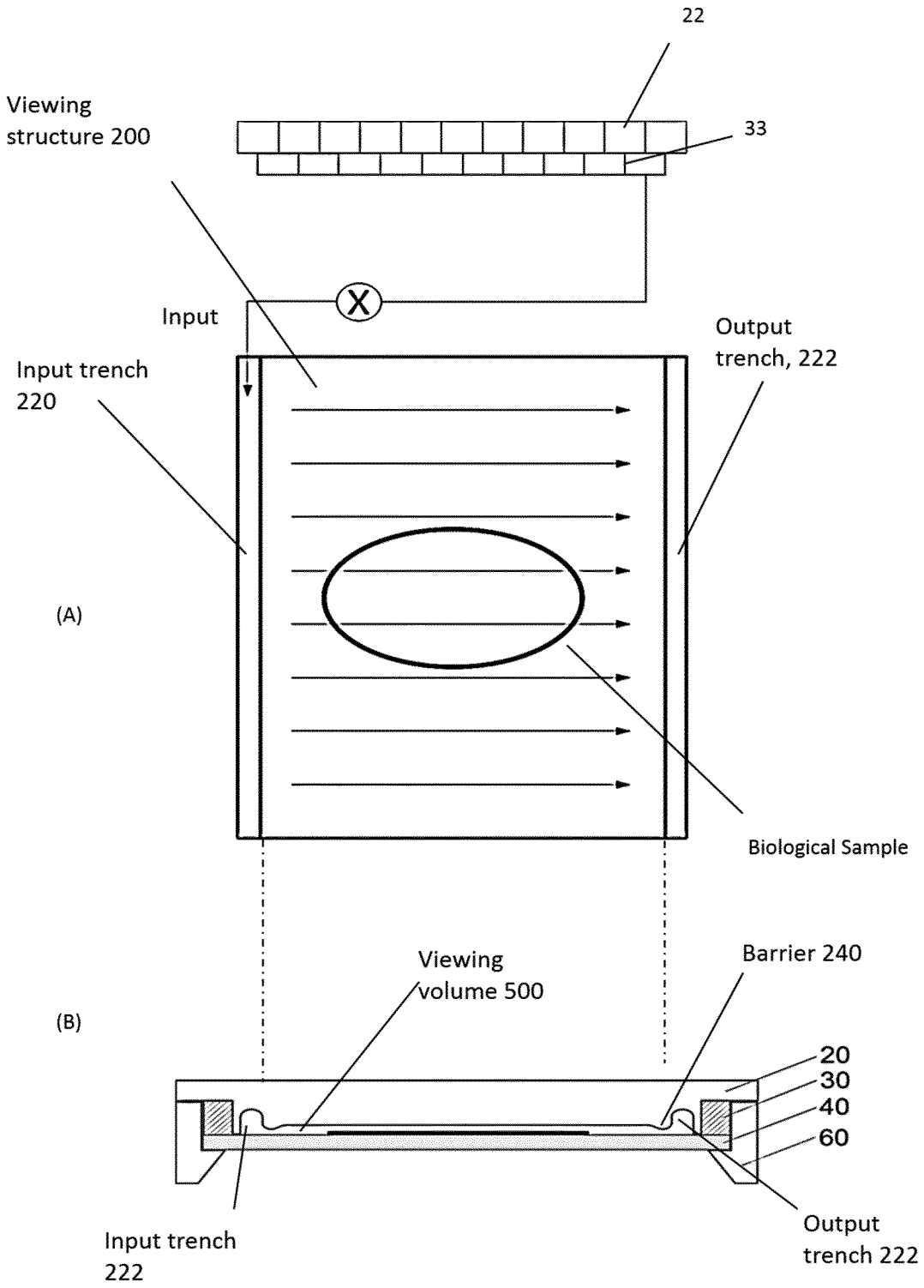
Fig. 12 A+B

MULTILEVEL DISPOSABLE CARTRIDGE FOR BIOLOGICAL SPECIMENS

BACKGROUND

This invention relates to a disposable for analyzing biological specimens.

Fluorescent dyes conjugated to one or more antibodies are commonly used for immunofluorescence analysis. A vast number of variants in terms of antibodies, fluorescent dyes, flow cytometers, flow sorters, and fluorescence microscopes has been developed in the last two decades to enable specific detection and isolation of target cells.

Fluorochrome conjugates targeting the antigen of interest are used to detect and image cell structures of tissues. In these techniques, sequential elimination of the fluorescence signal and re-staining allow a higher multiplexing potential compared to standard procedures using simultaneous labeling and detection. For example, U.S. Pat. No. 7,741,045 B2, EP 0810 428 B1 or DE10143757 disclose elimination of the fluorescence signal by photo- or chemical destruction of the conjugated fluorescent moieties.

In the aforementioned techniques, the resulting fluorescence signals are collected as an image. By sequential elimination of the fluorescence signal and re-staining with different fluorochrome-conjugates, different antigens are detected, resulting in a plurality of images of the same specimen showing different parts (antigens) of the specimen. The quality of the information gathered with these techniques is highly dependent on the resolution of the images, the precision of the handling steps and the time required between steps, during which the sample is manipulated. The known techniques allow a very limited number of images of a particular biological sample through a series of stainings, due to the laborious handling steps. Accordingly, there is a need for an automated procedure for cycles of staining, imaging and elimination of the staining of biological specimens for analyzing proposes.

SUMMARY

Described here is a system that allows sequential analysis of a biological sample in situ, under computer control. The device allows the sequential application of a number of fluorescent reagents to the same biological sample, and the observation of the sample through a transparent support by an imaging mechanism or by eye. The imaging mechanism may be a fluorescence imaging system which, in combination with a data-collecting computer, may form a visual image of the biological sample stained with a series of various reagents.

Central to the system is a multilevel disposable cartridge, which may be a small, inexpensive plastic cartridge composed of multiple layers. In one layer, a plurality of fluid wells or reservoirs may hold a plurality of fluid reagents. The disposable cartridge may also be configured to accept a biological sample on a transparent support, for example, on a glass slide.

The cartridge may include two rigid plastic layers and an elastomeric, flexible layer between the two rigid layers. The rigid layers may have small channels formed therein. The channels in one rigid layer may be configured for carrying fluids. The channels in the other rigid layer may be configured for carrying pneumatics, i.e. air pressure or suction. The pneumatic channels may deliver the pressure or suction to the underside of the elastomeric layer, thereby deflecting the elastomeric layer. This deflection may open or close a fluid valve, allowing fluid to flow in the fluid channels of the other rigid layer. In particular, a valve in the elastomeric layer may open a fluid channel between a fluid reservoir and a biological sample, to deliver a particular reagent to the sample.

Because these structures are all contained on a small, disposable cartridge, fluid volumes are minimized. The small volumes make efficient use of expensive reagents, minimize washing steps, and reduce the time needed to collect the data. Because the cartridge is disposable and all the fluid pathways are enclosed therein, there is no sterilization procedure, and the multilevel, disposable cartridge is simply thrown away.

Accordingly, a disposable for analyzing biological specimens, may include a first rigid layer (20), having a analyzing area (24), a plurality of fluid reservoirs (22) and a plurality of fluidic channels formed therein wherein the channels provide fluid communication to the fluid reservoirs and also include a flexible layer (30) having a plurality of fluid control points (33) in fluid communication with at least one of the fluid reservoirs (22). The disposable may further include a second rigid layer (40) with a plurality of pneumatic channels formed therein, wherein the channels provide pneumatic communication to the at least one fluid control point, wherein each fluid control point is pneumatically controllable to cause flow from only one of the plurality of fluid reservoirs (22) into and out of the fluidic channels.

The flexible layer (30) may be produced separate from first rigid layer (20) and second rigid layer (40) and disposable cartridge is assembled from the three separate layers as explained in detail in the following description. In this embodiment of the invention, the flexible layer (30) is produced separate from first rigid layer (20) and second rigid layer (40) and the disposable cartridge is assembled from the first rigid layer (20), the flexible layer (30) and the second rigid layer (40) each being a separate item.

In another embodiment of the invention, the flexible layer (30) is produced together with either the first rigid layer (20) or the second rigid layer (40). In this embodiment, the flexible layer (30) is produced for example by attaching, disposing or extruding of flexible material on or at the at the other rigid layers in a way that the functionality of the flexible layer (30) is still achieved but not as separate layer. In this embodiment, the disposable cartridge is assembled from the flexible layer (30) attached to the first rigid layer (20) and the second rigid layer (40) or from the flexible layer (30) attached to the second rigid layer (40) and the first rigid layer (20). In a variant of this embodiment, the flexible layer (30) is a continuous layer as shown for example in FIG. 1. In yet another variant, the flexible material is only attached, disposed or extruded at those locations of the rigid layers where the functionality of the flexible materiel is needed, like to provide the valve or pump function or as sealing material.

BRIEF DESCRIPTION OF THE DRAWINGS

Various exemplary details are described with reference to the following figures, wherein.

It should be understood that the drawings are not necessarily to scale, and that like numbers may refer to like features.

DETAILED DESCRIPTION

Systems and methods are described for analyzing a biological sample mounted on a transparent surface with a plurality of reagents in an automated fashion, using a multilevel, disposable cartridge. A plurality of reagents may each be stored in a separate fluid well on the cartridge. An elastomeric layer in the multilevel, disposable cartridge may be configured as the fluid valves and pumps, which allow the reagent fluid to flow from a well to a sample analyzing chamber in which the biological sample is placed. The fluid valves and pumps may be actuated using pneumatics from a source, and are under computer control. Accordingly, the biological sample may be analyzed with a plurality of reagents in an automated fashion. Because the fluid passages are very small, and contained within the multilevel disposable cartridge, the dead volume is small, and successive reagents can be applied in a short amount of time. The small volumes make efficient use of expensive reagents, minimize washing steps, and reduce the time needed to collect the data. Because the cartridge is disposable and all the fluid pathways are enclosed therein, there is no sterilization procedure, and the multilevel, disposable cartridge is simply thrown away.

Figure 1:
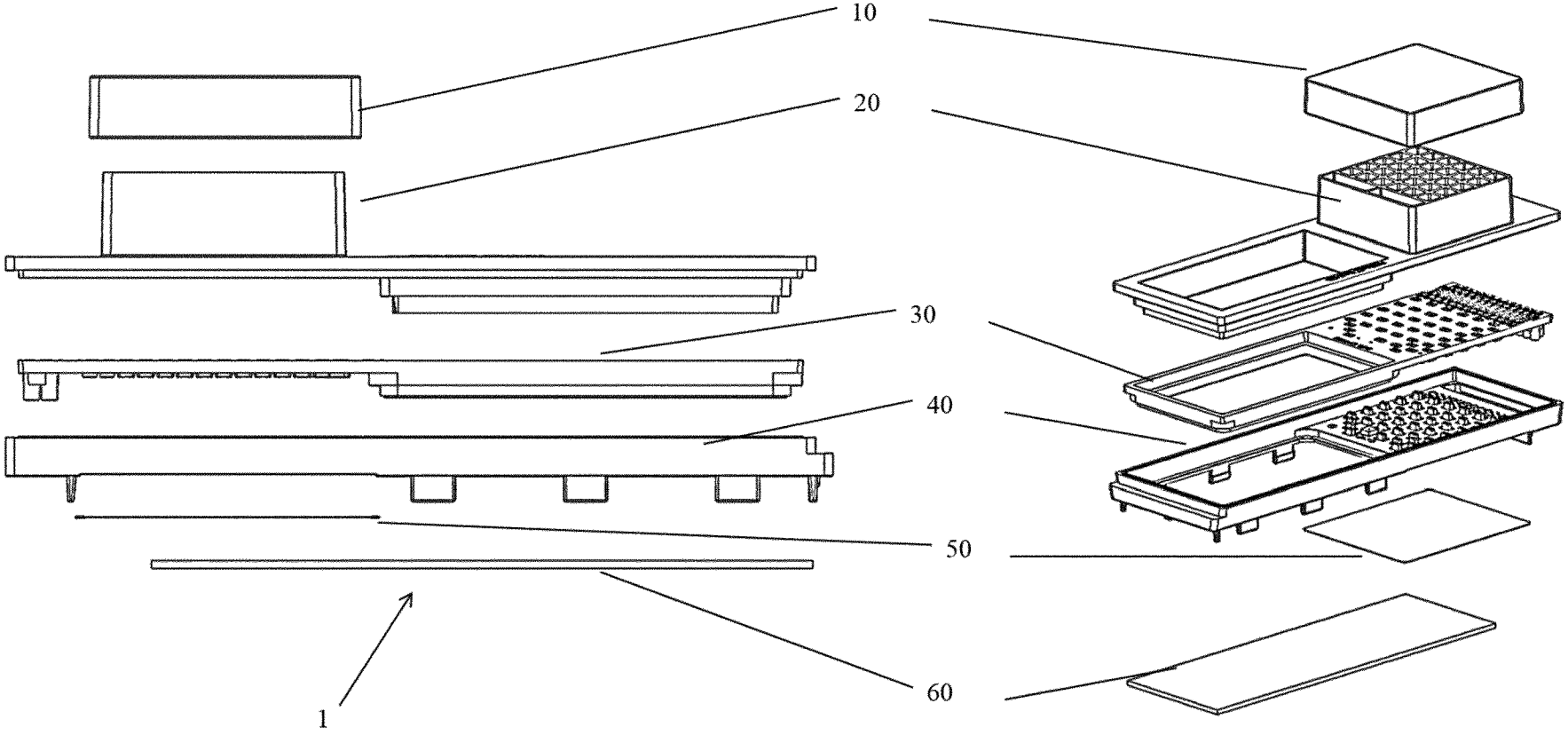
FIG. 1 is an exploded perspective view of the multilevel disposable cartridge.

FIG. 1 is an exploded, perspective view of the multilevel disposable cartridge 1. Included in the multilevel disposable cartridge 1 may be a number of components which can be assembled to form the multilevel disposable cartridge 1. The cartridge 1 may include a protective covering 10, or a top, and a first rigid layer 20. It may also include an elastomeric layer 30, and a second rigid layer 40. Finally it may include a foil covering 50 and a specimen support 60. One of these, the primary components are the first rigid layer 20, the elastomeric layer 30, and the second rigid layer 40. Details of these three components will be described in further detail below with respect to FIGS. 2 through 8.

The first rigid layer 20 and second rigid layer 40 may be comprised of a polymeric plastic, such as polycarbonate. The first rigid layer 20 and second rigid layer 40 may be injection molded. The elastomeric layer 30 may be made from a rubbery elastic material such as silicone, and may be stamped or otherwise formed in the structure shown. These components may be glued or snapped together to form the multilevel disposable cartridge 1.

The overall dimensions of the multilevel disposable cartridge 1 may be about 75 mm on a side, by about 30 mm in depth, by about 10 mm in height. It should be understood that these dimensions are exemplary only in the multilevel disposable cartridge 1 may be made of any convenient size, depending on the application.

The two rigid layers 20 and 40, may be separated by the elastomeric layer 30. The first rigid layer 20 may support the fluidic transport, and the second rigid layer 40 may support pneumatic structures such as channels and pores, which may deliver suction or vacuum to deformable portions of elastomeric layer 30. These deformable portions may comprise fluid control elements such as pumps and valves, as will be described further below. The remaining components such as the protective covering or top 10, the foil layer 50, and the transparent specimen support 60 maybe ancillary or optional. In some embodiments, the foil layer 50 may cover the pneumatic channels in the second rigid layer 40, so as to seal the gas therein. The specimen support 60 may carry the biological specimen on its surface and maybe sealed against the first rigid layer 20 by a seal, preferably by the flexible elastomeric layer 30, as will be described further below.

Figure 3:
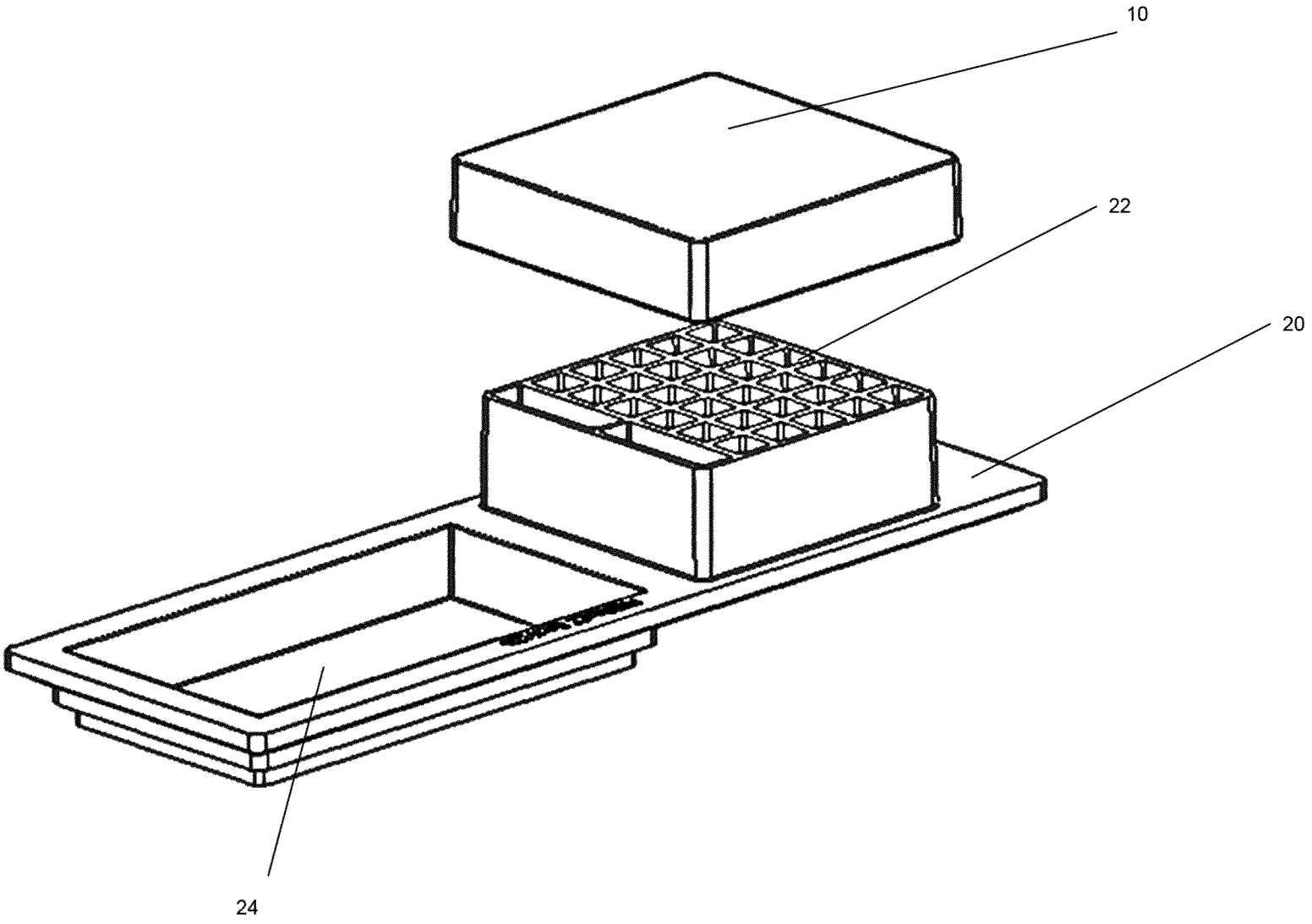
FIG. 3 is an enlarged view of the top cover and first rigid layer of the multilevel disposable cartridge.

Analyzing the biological specimens may be conducted by optical microcopy and/or any method detecting emission, for example with a digital camera. Depending on the location of the light source and the detection means, analyzing area 24 (as seen in FIG. 3) and/or specimen support 60 may be transparent for light having a wavelength between 200 and 100 nm. In the embodiment shown in FIG. 1, analyzing area 24 may be an integral part of first rigid layer 20 and specimen support 60 may be a separate part to be attached to second layer 40. It should be noted that in another embodiment, analyzing area 24 may be separate part to be attached to first rigid layer 20 and support 60 can be an integral part of second rigid layer 40.

Accordingly, a disposable for analyzing biological specimens may include a first rigid layer (20), having a analyzing area (24), a plurality of fluid reservoirs (22) and a plurality of fluidic channels formed therein wherein the channels provide fluid communication to the fluid reservoirs and also include a flexible layer (30) having a plurality of fluid control points (33) in fluid communication with at least one of the fluid reservoirs (22). The disposable may further include a second rigid layer (40) with a plurality of pneumatic channels formed therein, wherein the channels provide pneumatic communication to the at least one fluid control point, wherein each fluid control point is pneumatically controllable to cause flow from only one of the plurality of fluid reservoirs (22) into and out of the fluidic channels.

Figure 2:
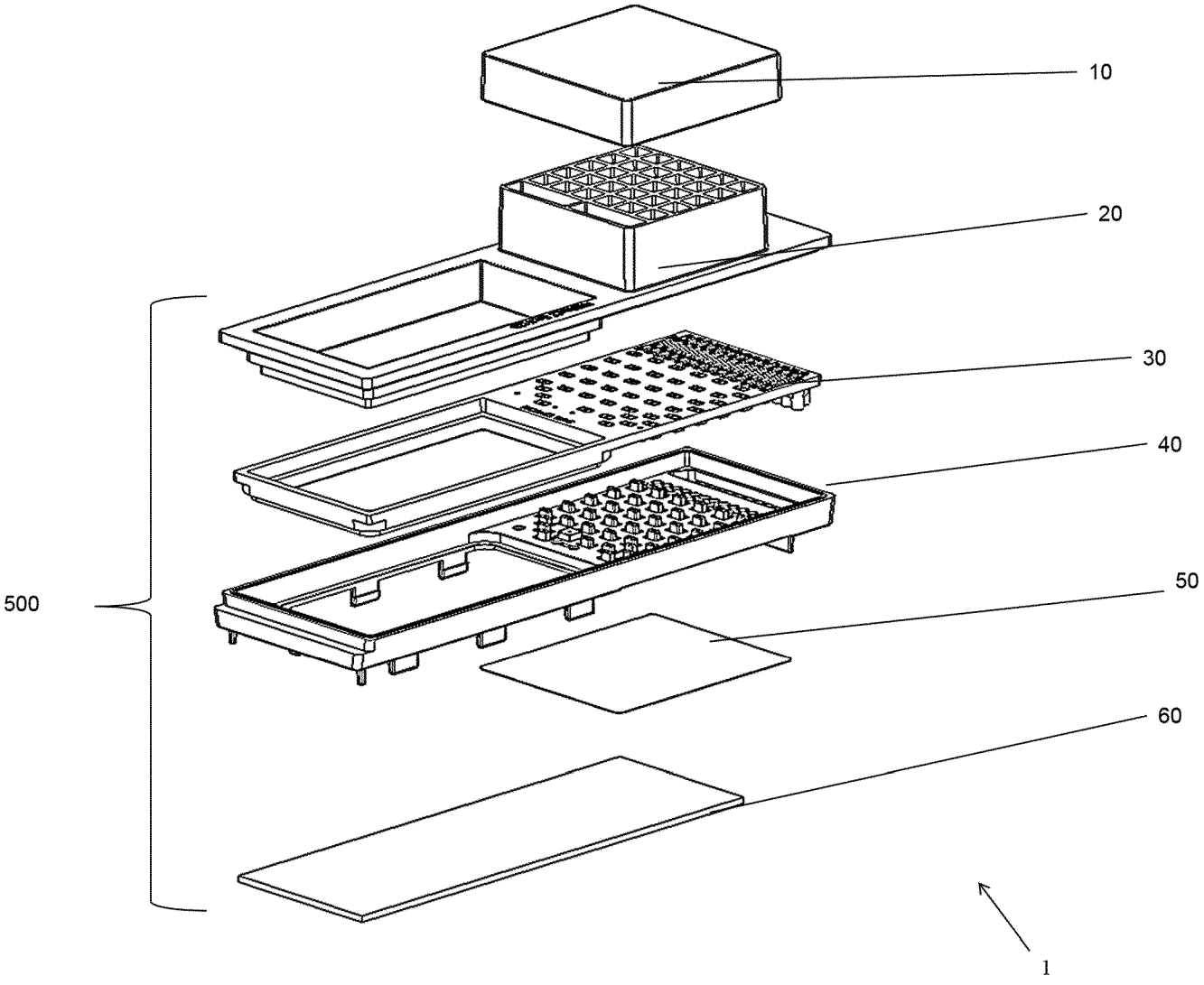
FIG. 2 is an enlarged perspective view of the multilevel disposable cartridge.

FIG. 2 is an expanded view of the exploded multilevel disposable cartridge 1. The same components are shown in perspective as were shown in FIG. 1. They include the protective covering 10, the first rigid layer 20, the elastomeric layer 30, the second rigid layer 40, foil covering 50 and the support 60. As can be seen in FIG. 3, the first rigid layer 20 may include a plurality of fluid wells or reservoirs 22. The fluid from these wells or reservoirs 22 may be pumped through a plurality of valves in the elastomeric layer 30, and to the sample analyzing chamber 500. In the sample analyzing chamber 500, the fluid may be applied to a biological sample. The sample analyzing chamber 500 may include at least portions of the first rigid layer 20, the elastomeric flexible layer 30, and the second rigid layer 40. The specimen support 60 may be held against this sample analyzing chamber 500 by an attachment mechanism such as a set of clips. These additional features will be described below with respect to FIGS. 3 through 6.

FIG. 3 shows in greater detail some of the features of the first rigid layer 20 and the protective covering 10. The protective covering 10 maybe a piece of sealing film or plastic material, which may be shaped to cover the protruding portions of the first rigid layer 20. These protruding portions may include a multitude of small fluid wells or reservoirs 22. The plurality of fluid wells or reservoirs 22 may be grouped together on one side of the first rigid layer 20 such that they can be covered by the top protective covering 10. The plurality of fluid wells or reservoirs 22 may each be filled with a different compound.

The plurality of fluid wells or reservoirs 22 may be filled with the separate, different, biologically reactive material such as such as reagents, antigen recognizing moieties having detection moieties, such as antibodies with fluorescent dyes, antibiotics, biological nutrients, toxins, stains, oxidants. In one embodiment, the fluid wells or reservoirs 22 may contain an antibody conjugated to a fluorescent dye moiety. The plurality of fluid wells or reservoirs 22 may serve as a reservoir for each of these reagents, whereby they may be sequentially applied to a biological specimen, as will be described in further detail below. Each of the fluid wells or reservoirs 22 may be independently accessed by an array of fluid control points which may be disposed below them and formed from the elastomeric layer 30. Accordingly, the first rigid layer may include a plurality of fluidic channels through which fluids may flow from the plurality of fluid wells or reservoirs 22 to the sample analyzing chamber 500. These fluidic channels may be disposed on the underside of the first rigid layer 20, and so are not shown in FIG. 3.

On the other side of the first rigid layer 20 is a analyzing area, such as depression or analyzing area 24 which may be disposed over the sample analyzing volume 500. The depression or analyzing area 24 may be made of the same polycarbonate material of the first rigid layer 20. Depression or analyzing area 24 may be a transparent viewing window or viewing surface formed in the first rigid layer 20, using the same material as the first rigid structure. For example, the viewing depression or analyzing area 24 may comprise a transparent polycarbonate plastic. The viewing depression or analyzing area 24 may be the part of the rigid layer 20 which may be pressed against the biological sample, and against the specimen support 60 upon which the biological sample may be placed. These features will be described further below. The first rigid layer 20 may be sealed against the elastomeric layer 30 with a non-leaking fluid seal. Similarly, the elastomeric layer 30, may also form a fluid seal against the support, 60. Accordingly, the flexible elastomeric layer (30) may seal the first rigid layer (20) against the second rigid layer (40) and/or the second rigid layer (40) against the specimen support (60).

Figure 4:
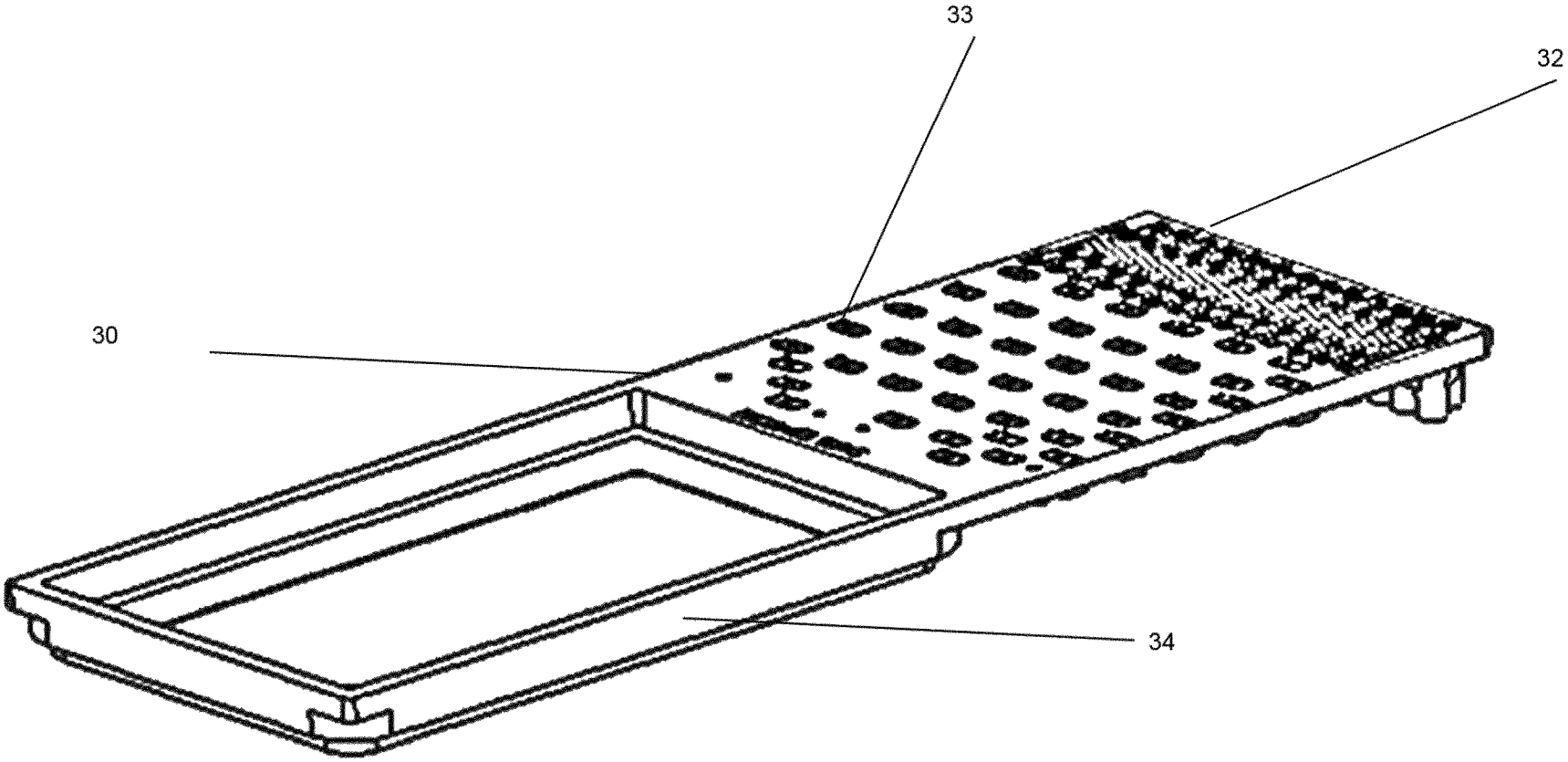
FIG. 4 an enlarged view of the elastomeric layer of the multilevel disposable cartridge.

Some details of the elastomeric layer 30 are shown in FIG. 4. Elastomeric layer 30 may include an input output port region 32 and a plurality of fluid control points 33, all formed in elastomeric layer 30. The input output ports 32 may provide a rubberized, non-leaking seal between the source of pressure or vacuum, and the pneumatic channels in the second rigid layer 40. These pneumatics may drive the functioning of the plurality of fluid control points 33. The pressure and vacuum will provide the pneumatic force for opening and closing the plurality of fluid control points 33, and may enter the elastomeric layer 30 through the plurality of input/output ports 32. The fluid control point 33 may be, for example, a part of a fluid valve or a pump.

Both of these mechanisms, the valves and the pump, are fluid control points, and are described in detail below. The fine features of the pumps and valves are difficult to depict on the scale used in FIG. 2. Therefore, these details are shown explicitly in FIGS. 3-6.

Finally, the elastomeric seal 34 may include a rubberized seal, that provides the fluid seal between the first rigid layer 20, and the second rigid layer 40, and the specimen support 60.

Figure 5:
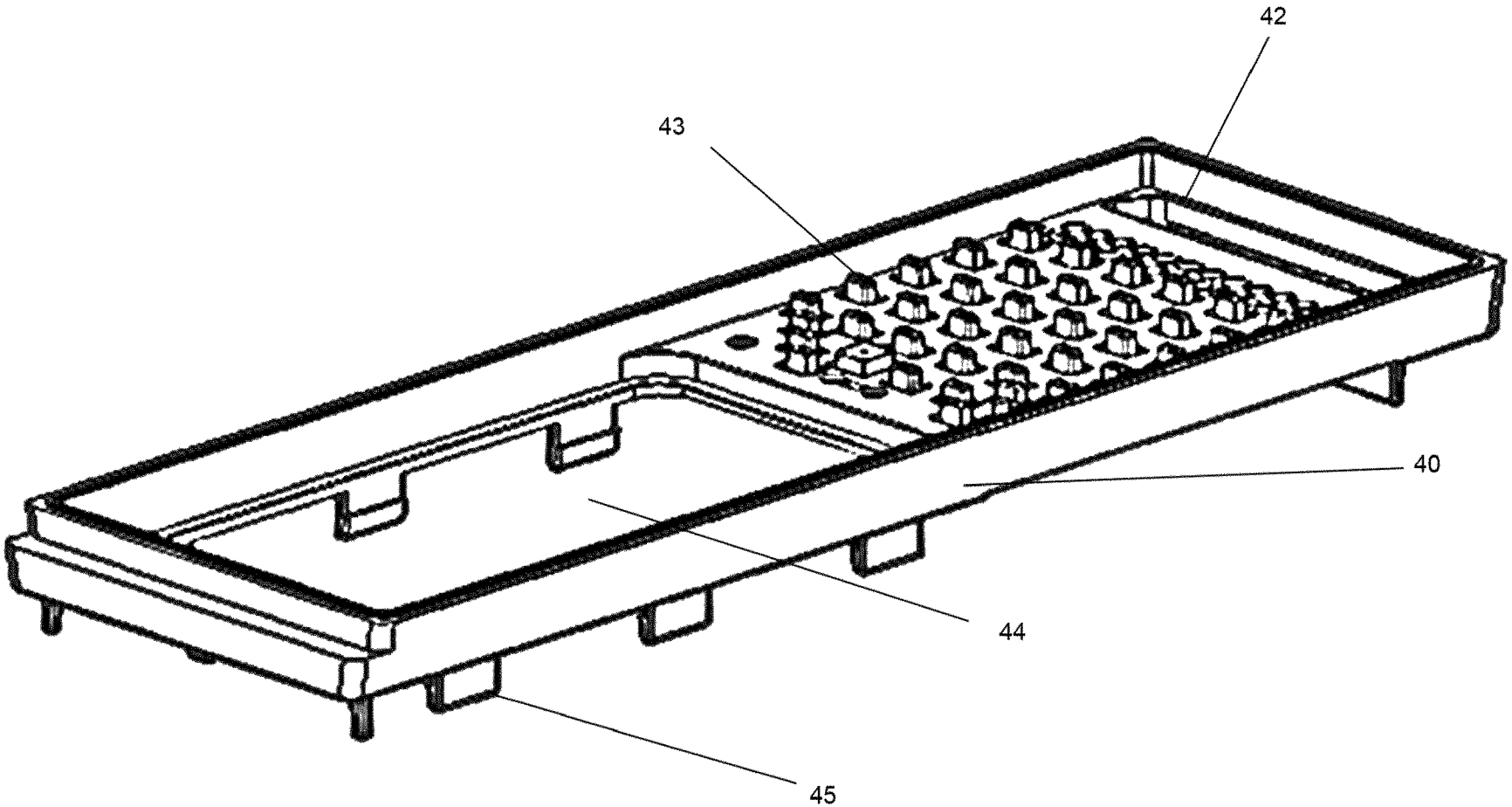
FIG. 5 is an enlarged view of the second rigid layer of the multilevel disposable cartridge.

FIG. 5 is a detail view of the second rigid layer 40. Shown in FIG. 5 is a input/output port aperture 42 and a plurality of raised pressure points 43. Also shown is a view of aperture 44 and clamping structures 45. The input output aperture 42 allows the coupling of the pneumatic sources of pressure or vacuum to the multilevel disposable cartridge 1. These sources may be found outside the multilevel disposable cartridge 1.

The plurality of raised pressure points 43 applies the suction or pressure obtained from the suction or pressure sources to the plurality of valves 33 of the elastomeric layer 30. Accordingly, to allow fluid to flow in and out of the sample analyzing volume (500), fluidic control points are pneumatically controlled by a suction applied from a pneumatic channel of the second rigid layer against the backside of the flexible elastomeric layer 30, whereby the flexible elastomeric layer (30) may be withdrawn from a first stop against a second stop. In order to prevent fluid from flowing in and out of the sample analyzing volume (500), fluidic control points may be pneumatically controlled by a suction removed from a pneumatic channel of the second rigid layer 40 against the backside of the flexible elastomeric layer 30, whereby the flexible elastomeric layer 30 rests against a first stop. The functioning of the valve in response to pressure or suction is described below with respect to FIGS. 7-10.

A viewing aperture 44 allows the depression or analyzing area 24 which may be formed in the first rigid layer 20, to protrude through the elastomeric layer seal 34 and through the second rigid layer 44 against the biological specimen resting on the transparent specimen support 60. The specimen support 60 may be held against the second rigid layer 40 by the clamps 45. Accordingly, the second rigid layer further comprises an attachment mechanism (45) like clamps for holding the specimen support (60), wherein the specimen support (60), the rigid layers (20, 40) and the flexible membrane (30) define the sample analyzing volume (500).

Figure 6:
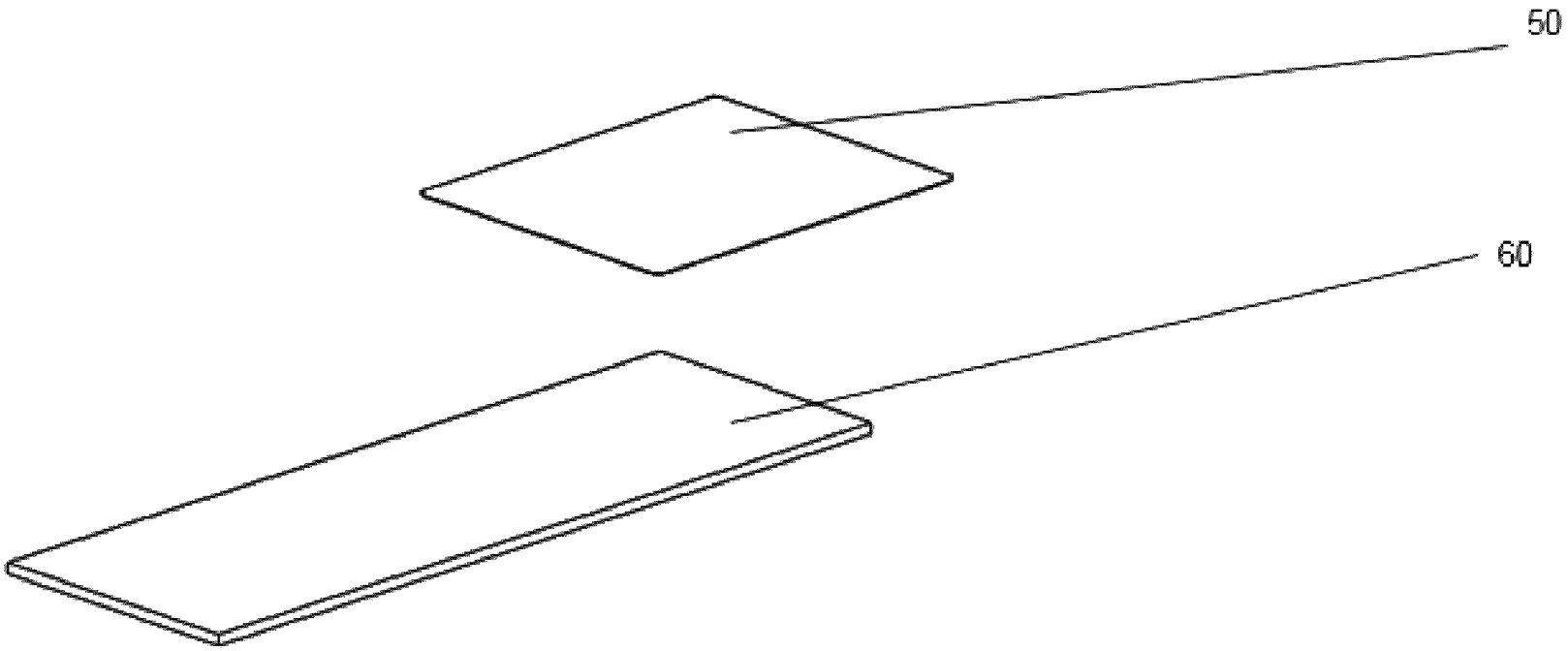
FIG. 6 is an view of adhesive foil backing and transparent glass slide for holding a biological specimen.

FIG. 6 shows the remaining two structures of the multilevel disposable cartridge. These final structures may be a foil covering 50 and a specimen support 60, like a transparent glass slide. The foil covering 50 may be, for example, a thin metallic sheet such as aluminum foil and may have an adhesive backing. This foil covering 50 may be applied to the backside of the second rigid layer 40. The backside of the a second rigid layer 40 may have pneumatic channels formed therein. Accordingly, the foil 50 may seal the exposed portion of the pneumatic channels in second rigid layer 40.

Specimen support 60 may be an optically transparent standard glass slide, upon which biological sample may be resting. The biological sample may be cells such as T cells, stem cells or lymphocytes, or tissue, for example.

Figure 7:
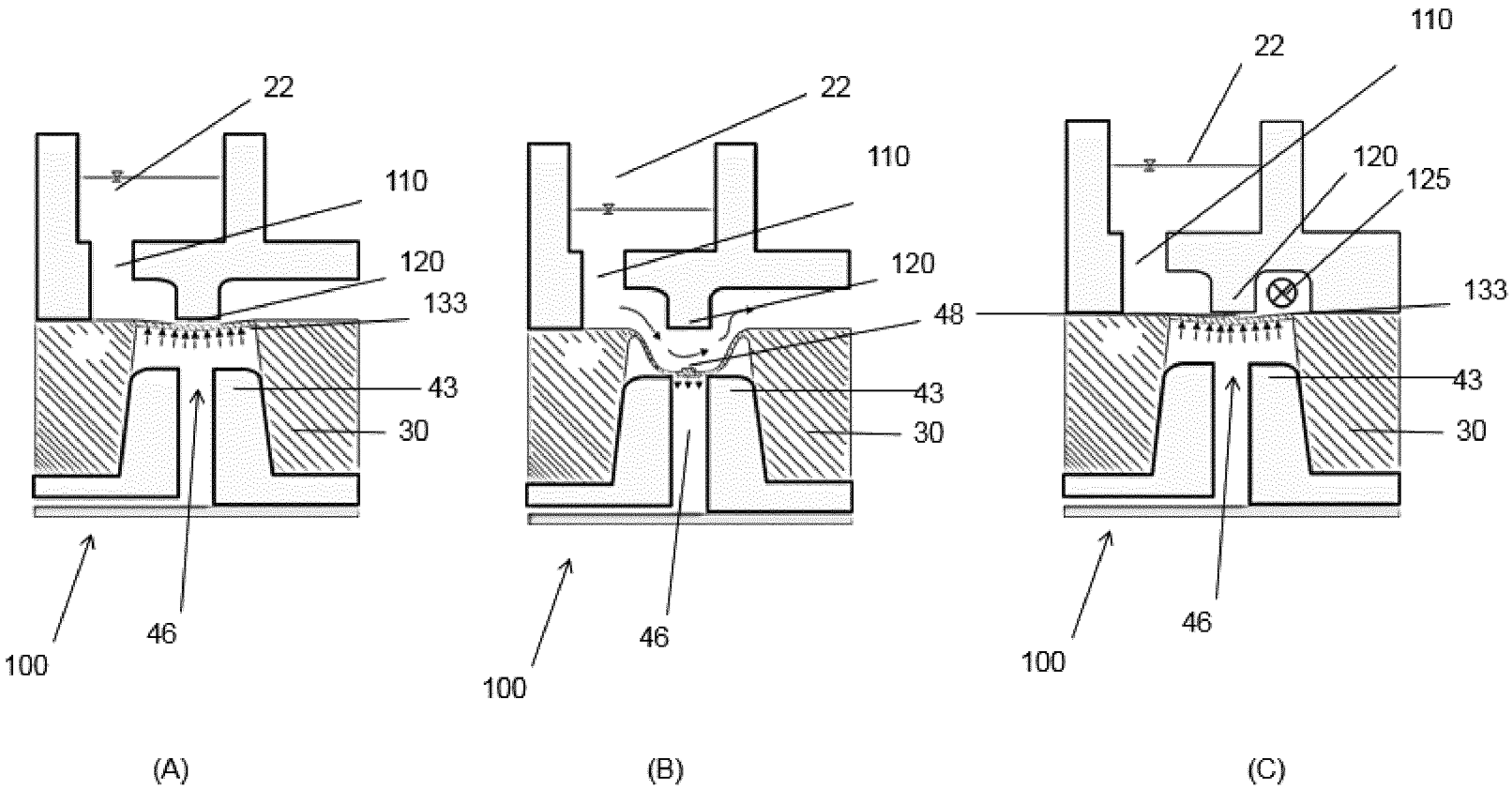
FIG. 7 is a detailed cross sectional view of one of the plurality of fluid valves.

FIG. 7 explains the functioning of an individual valve 100 in greater detail. Each of the three layers of the disposable cartridge 1, the first rigid layer 20 elastomeric layer 30 and the second rigid layer 40 may participate in the functioning of a single individual fluid control point 33. In a preferred embodiment, the fluid control point (33) may be a thinned portion (133) of the flexible layer (30). The thinned portion (133) may have a thickness of ⅕ to 1/20 of the thickness of the flexible layer (30). As shown in FIGS. 7-10, a fluid control point 33 may include one or more valves (100, 300) and, optionally, a pumping mechanism (200).

FIG. 7 has a cutaway view of each of the first rigid layer 20, the elastomeric layer 30, and the second rigid layer 40 in the vicinity of a valve 100. The first rigid layer 20 may have the following features which participate in the valve functioning: An aperture 110 and a raised structure 120. An individual valve 100 maybe located underneath each individual fluid well or reservoir 22 as shown in FIG. 7. The aperture 110 may provide a flow path from the fluid well or reservoir 22 past the raised feature 120, and into a flow channel 125. Accordingly, the fluidic control points are configured as thinned portion (133) in the flexible elastomeric layer (30) with a thinned portion (133) of the flexible elastomeric layer that is deflected against a first stop (120) and a second stop (43). In the vicinity of the raised feature 120, the presence of the flexible elastomeric layer 30 may prevent flow from the fluid reservoir 22 into the exit channel 125, in general. The valve is normally closed as shown in FIG. 7A.

In FIG. 7B, suction is applied to the underside of the elastomeric layer 30, pulling the elastomeric membrane 30 down and out of the way of the raised feature 120. The suction thereby opens a flow path between the fluid reservoir 22 and the exit channel 125. The elastomeric layer 30 is pulled against the pressure point 43 in the second rigid layer 40, which serves as a second stop 43 for the elastomeric layer 30. Accordingly, the fluid control point comprises a raised feature 120 in a fluidic channel of the first rigid layer (20) as first stop raised feature (120) for the thinned portion (133) of the flexible layer (30) and an opening in a pneumatic channel of the second rigid layer (40) as second stop (43) for the thinned portion (133) of the flexible layer (30) wherein the thinned portion (133) opens and closes the fluidic channel of the first rigid layer.

As can be seen in FIG. 7, the elastomeric layer 30 may include a section of thinner elastomeric material, thinned portion 133, that flexes easily, allowing these motions to occur with a modest amount of pressure or vacuum. These thinned portions 133 may be, for example, 50-200 μm in thickness compared to the rest of the elastomeric layer, which may have a thickness of at least 250 μm up to about 5 mm. Raised feature 120 in the first rigid layer 20 may be a first stop, and pressure point in second rigid layer 40 may be a second stop 43 for the thinned portion 133 of the flexible layer. The flexible elastomeric layer 30 may be disposed around these features as shown in the cross sections of FIG. 7. Accordingly, the second rigid layer may comprise a pressure point (43) which may protrude into a cavity of the flexible layer as second stop (43) for the thinned portion (133) of the flexible layer (30). When suction is applied from the pneumatic channel of the second rigid layer against the backside of the flexible membrane layer 30, the flexible membrane layer 30 may be withdrawn from the first stop raised feature 120 and pulled against the second stop 43 allowing fluid to flow from the reservoir into the fluidic channel of the first rigid layer 20. The thinned portion 133 of the flexible elastomeric layer 30 may be deflected against the first stop raised feature 120 and the second stop 43.

In FIG. 7C, the suction may be removed, allowing elastomeric membrane 30 to resume its position against the raised feature 120. The elastomeric membrane 30 may thereby block the fluid from the fluid reservoir 22 into exit channel 125. Accordingly, in FIG. 7C, the first valve 100 may be closed. The configuration of the first rigid layer 20 shown in FIG. 7C may be used to direct fluid from reservoir 22 into another fluid flowing thorough channel 125. This variant may enable mixing of two streams of fluid rather than an on/off valve as shown in FIG. 7A and FIG. 7B. The pneumatic pressure may be delivered to and from the thinned portion 133 of flexible membrane 30 by a plurality of small channels 46 formed in the pressure point second stop 43.

Close inspection of FIGS. 7A, 7B and 7C may reveal another important feature of the flexible membrane 30. This may be a small protrusion or "button" 48 on the thinner portion 133 of flexible elastomeric layer 30. The button 48 may be a thicker and/or stiffer portion of the flexible layer 30, which is stiff enough to span the pneumatic opening in the pressure point 43. This button 48 may help to form a fluid-tight seal against the upper and lower stops, raised feature 120 and pressure point second stop 43. Against the upper stop 120, the button 48 may form a small segment of elastomeric barrier as a barrier against the flow. Against the lower stop pressure point 43, the button 48 may form a stiffened region that it can adequately span the second stop pressure point 43. It should be appreciated that the location of pressure point 43 in cavities in the flexible membrane 30 may also help to locate, or register, the pressure points 43 in the appropriate spaces directly beneath the thinned portions 133 of flexible membrane 30. Accordingly, in this multilevel disposable cartridge, the pressure point 43 may protrude into the cavity, thereby registering the flexible membrane 30 with respect to the rigid layer 40, and at a location adjacent to a button formed on the thinned portion 133 of the flexible layer 30.

Figure 8:
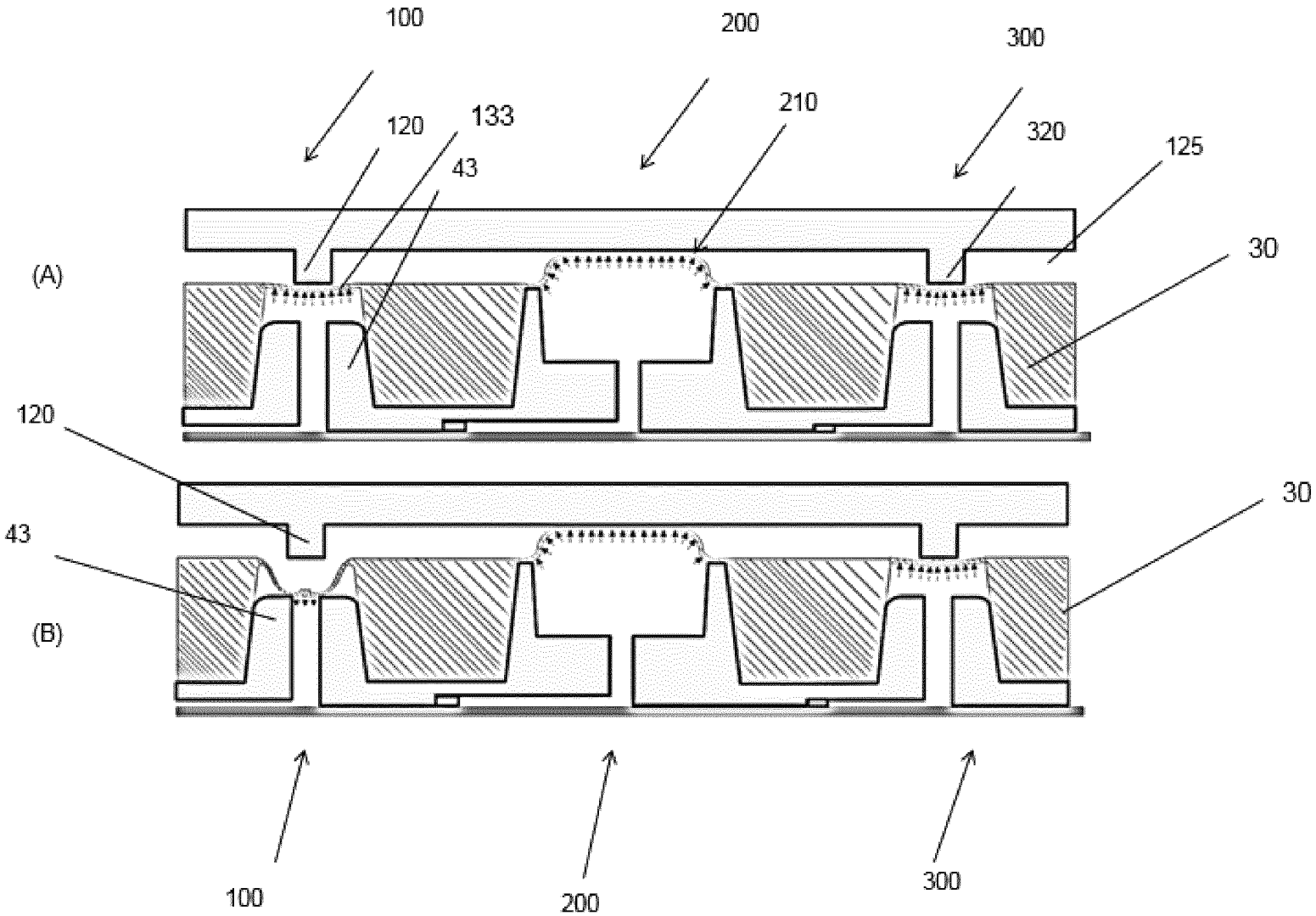
FIG. 8 is a detailed view of a pumping mechanism in the multilevel disposable cartridge in a first portion of a pumping cycle.
Figure 9:
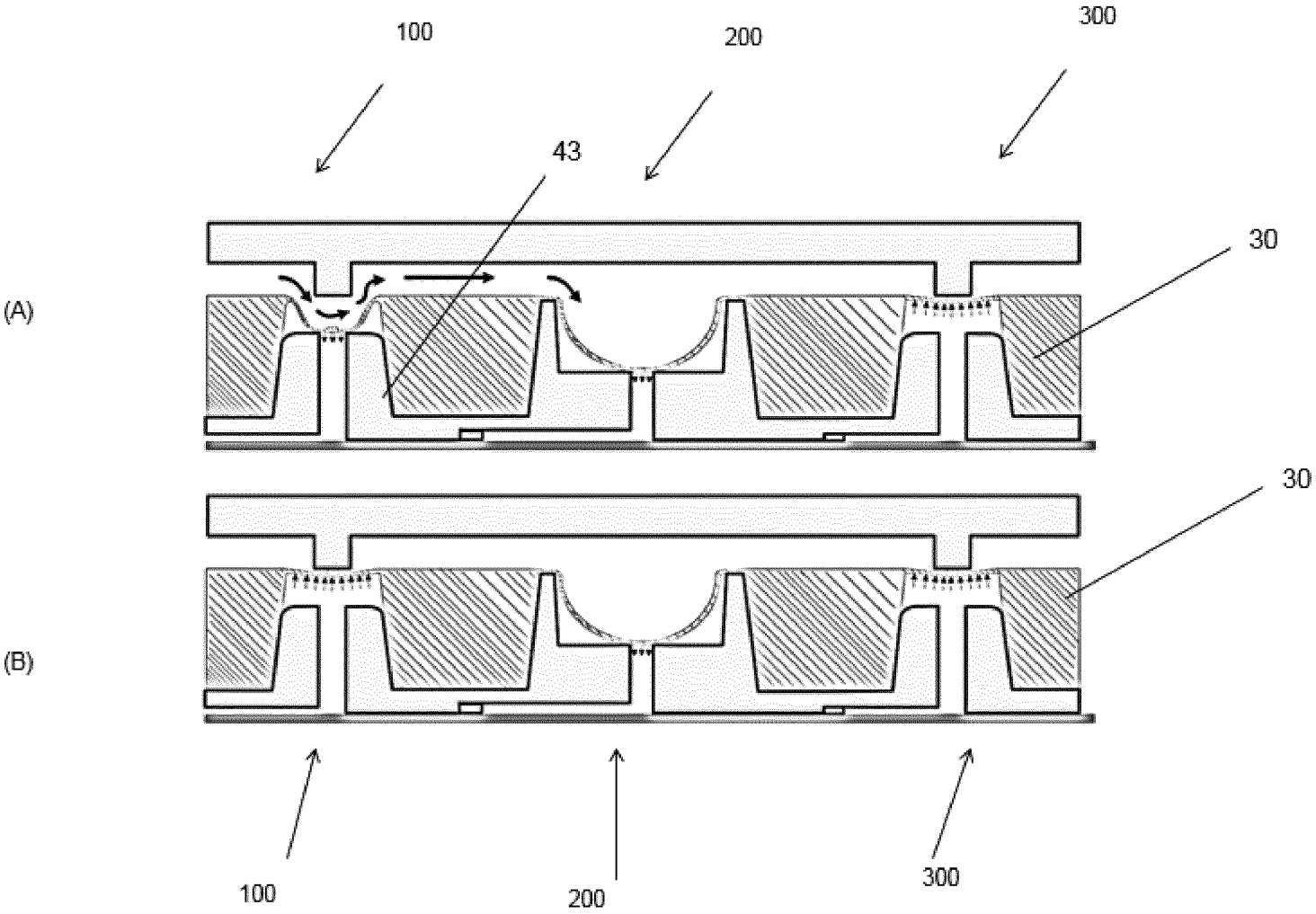
FIG. 9 is a detailed view of a pumping mechanism in the multilevel disposable cartridge in a second portion of a pumping cycle.
Figure 10:
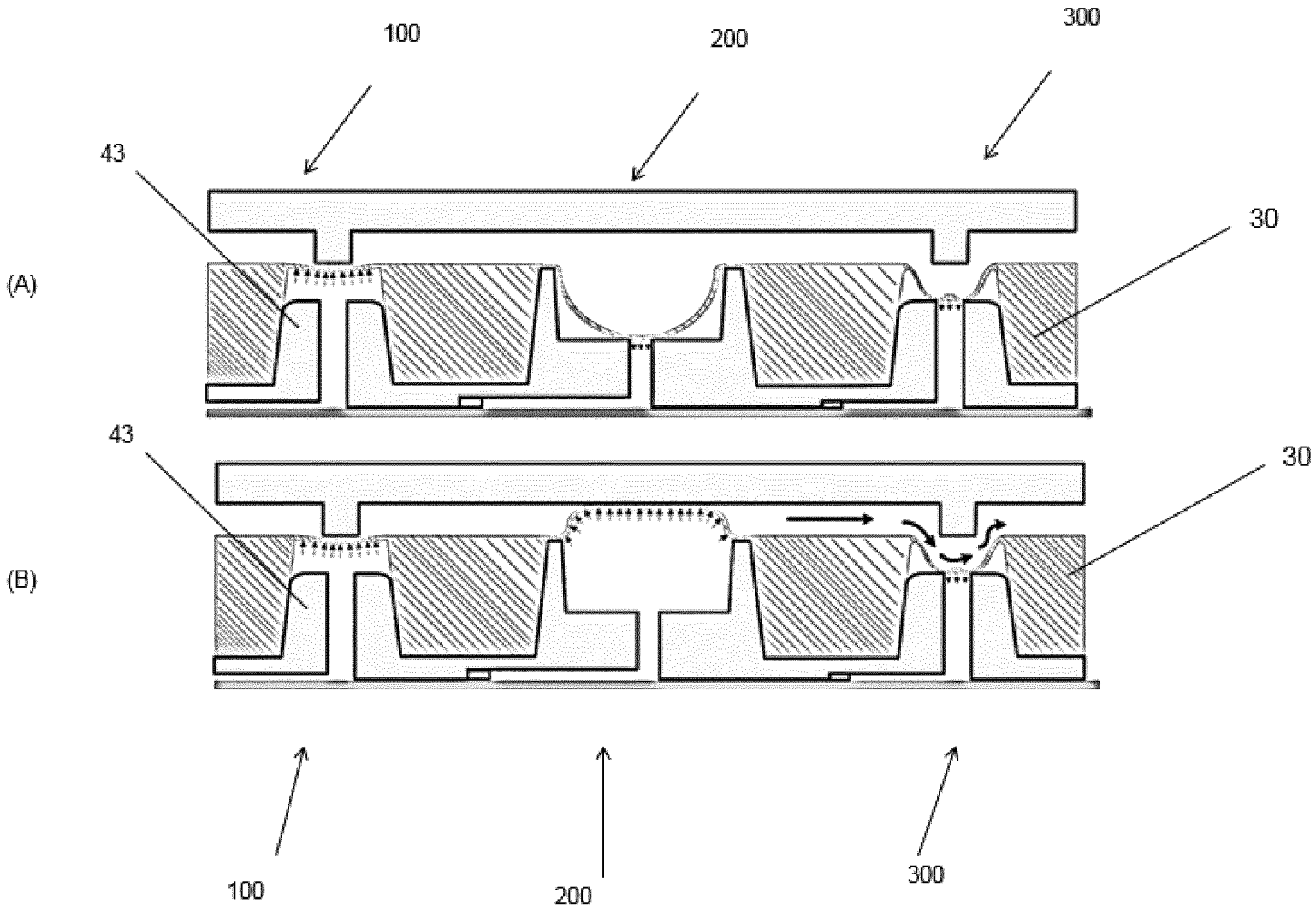
FIG. 10 is a detailed view of a pumping mechanism in the multilevel disposable cartridge in a third portion of a pumping cycle.

The multilevel disposable cartridge 1 may further comprise a fluidic pump which pumps fluid through the multilevel disposable cartridge 1. This fluidic pump may be a part of the flexible layer (30), wherein the flexible layer (30) further comprises a pumping mechanism (200) actuated by a pneumatic force. The pumping mechanism (200) may comprise a movable part (210) in the flexible layer (30) configured to alter the volume of a fluidic channel and wherein said movable part (210) is in fluidic communication between a first valve (100) and a second valve (300). FIGS. 8 through 10 illustrate the functioning of a fluidic pump, which uses many similar structures as shown in FIG. 7 for the valve 100. FIG. 8 shows a first valve 100, a pumping mechanism 200 and the second valve 300. These three structures may function together to pump fluid through a fluid path 125. As shown in FIG. 8A, to begin with, fluid valve 100 and fluid valves 300 are both closed. Pressure is applied through the second rigid layer 40 causing the elastomeric membrane 30 to be deflected upward, against the raised feature 120 of the first rigid layer 20 and the second raised feature 320. Accordingly, the first valve 100 and the second valve 300 are both closed, and no fluid flows.

In FIG. 8B, the first valve 100 may be opened by the application of a suction pressure to the raised pressure point 43 of the second rigid layer 40. The suction pulls the elastomeric membrane 30 down against and away from the raised feature 120 opening a fluid channel past the first valve 100.

However pumping element 200 may still be in the closed position against second stop pressure point 43. Second valve 300 may also be in the closed position. Accordingly, no fluid may flow through the structure. In FIG. 9A, the pumping element 200 may be activated. In other words, a suction pressure may be applied to the port of pumping element 200, drawing the elastomeric membrane 30 down into the pumping element 200. This opens a fluid path for fluid to flow past the first valve 100 and into the pumping element 200. However, the second valve 300 is still closed. Accordingly, fluid does not flow beyond the second valve 300. In FIG. 9B, the first valve is also closed, such that the fluid is confined between the first valve 100 and the second valve 300, in the space of the pumping element 200.

In FIG. 10A, the second valve 300 is open by application of a suction pressure to the corresponding pressure point second stop 43 of the second rigid layer 40. This draws the elastomeric layer 30 down and away from the raised feature 120. This opens a fluid path from the pumping element 200 into the outside world. In FIG. 10B, the pumping element is deflected by application of a pressure to the pumping element 200. This deflects the elastomeric membrane up against the first stop 120 of the first rigid layer 20. The movement of the elastomeric membrane 30 causes the fluid to flow from the pumping mechanism 200 through the second valve 300 and into the space beyond.

These figures taken together FIGS. 8A, 8B, 9A, 9B, 10A and 10B illustrate the pumping action by sequential activation of the first valve 100, the pumping element 200 and the second valve 300. Using this combination of structures, fluid can be pumped from any arbitrary fluid well or reservoir 22 into the sample analyzing volume 500 (depression or analyzing area 24, rubberized seal 34 and aperture 44) as was shown in FIG. 2. Accordingly, the multilevel disposable cartridge 1 may include a pumping mechanism which pumps a fluid through the disposable cartridge, using the flexible elastomeric membrane layer 30 as the pumping source, when the pumping mechanism 200 is coupled to a source of pneumatic force.

Figure 11:
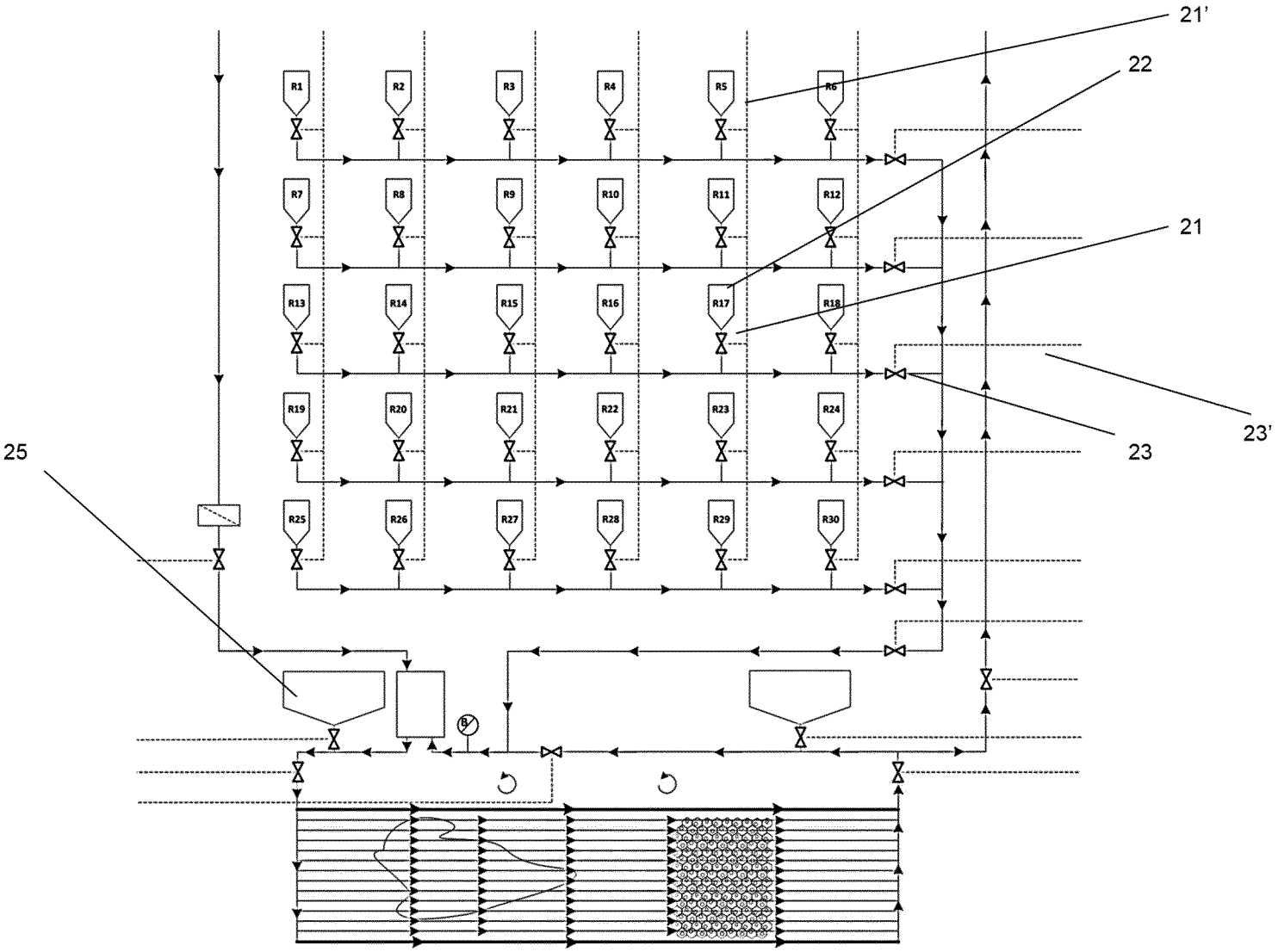
FIG. 11 is a schematic view of the array for the multilevel disposable cartridge.

FIG. 11 is a schematic illustration of the array architecture of the multilevel disposable cartridge 1. As can be seen in FIG. 11, the architecture may have a row/column structure wherein each individual fluid vessel may be accessed by the application of the suction or pressure to both a row, and a column. For fluid to flow from any arbitrary reservoir 22, as shown in FIG. 11, for example, suction or pressure may be applied to the third column 21' of pneumatic channels. This may activate the valves on all of the fluid reservoirs in the column, including reservoir 22, and all those above and below fluid reservoir 22. Accordingly, for fluid to flow from the proper fluid reservoir 22, the row valve 23, would also be opened by pneumatic channel 23'. The opening of the row valve 23 causes fluid to flow only from the proper fluid receptacle 22 through valve 23 and 21 across the sample analyzing chamber as shown in FIG. 11. Other structures shown in FIG. 11 such as larger reservoir 25 may be used to hold larger volumes of fluid, for example to hold buffer solution. Accordingly, these larger reservoirs may be used to store larger quantities of fluids. The pumping mechanism may recirculate this fluid to and from the sample analyzing volume 500.

Using this array architecture, each fluid well may be addressed with a minimum number of pneumatic lines. Therefore, in this system, the second rigid layer 40 may comprise a first pneumatic channel providing suction to a row of fluidic control points 33, and a second pneumatic channel providing suction to a column of fluid control points 33, such that the two pneumatic channels together cause fluid to be dispensed from only one of the fluid reservoirs at a time.

Figure 12C:
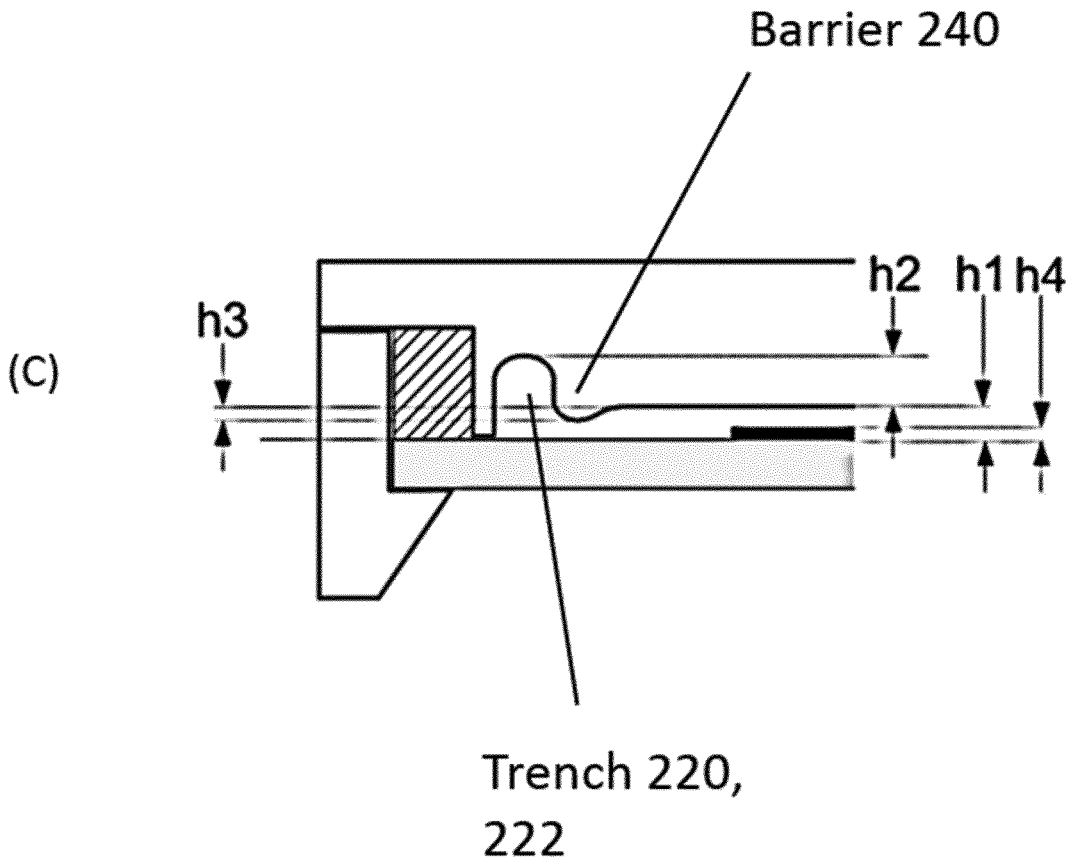
FIG. 12 shows a schematic view of the fluid flow paths for the multilevel disposable cartridge; (A) shows the plan view (B) shows the cross section and (C) shows the detailed dimensions of the features.

FIG. 12 illustrates schematically how the fluid flows in the multilevel disposable cartridge 1. In FIG. 12, the fluid reservoirs 22 are shown disposed above the sample analyzing volume 500. As described above, each of the reservoirs disposed in the first rigid layer 20 has a fluid control valve beneath it which is comprised of the elastomeric layer 30 actuated by pneumatics from the second rigid layer 40. These structures 20, 30 and 40 function together to form the elastomeric valve as described above.

In any case, the fluid flows through an input trench 220 into the sample analyzing volume 500. In another embodiment, this fluid is distributed before entering the sample analyzing volume 500 over at least one side to achieve a flow parallel to this side and over the sample as to prevent a laminar flow which might leave out parts of the sample. To this end, the first rigid layer 20 may further comprise at least one cavity or trench (220, 222) adjacent to at least one side of the sample analyzing volume (500), which accepts and distributes fluid flowing from at least one reservoir 22 over the whole side of the analyzing volume (500). The trenches are shown in detail in FIGS. 12B and 12C. The shape of the trench is preferably chosen to minimize resistance to fluid flow in certain directions. This allows the fluid to cover the sample uniformly, as explained further below. Preferably, the input trench (220) has an asymmetric cross-section.

For example, the fluid may flow from left to right as shown in FIG. 12 (A). Accordingly, fluid flows from the fluid well or reservoir 22 through a fluid control point 33 into an input trench 220 disposed on one side of the sample analyzing volume 500, i.e. on one side of the depression or analyzing area 24 in the first rigid layer 20. The fluid may fill this trench 220 and enter the sample analyzing volume 500 with a controlled flow over the whole side rather than at the entry of the channel only. The trench may have a depth/height of h2 (about 300 μm) and a asymmetric cross sectional shape shown in detail in FIGS. 12 (B) and (C). The first rigid layer may be provided with at least one output trench (222 in FIG. 12B) located at the opposite side of the sample analyzing area collecting all fluid provided by input trench 220. The output trench 222 may, but need not, have the same cross sectional profile as the input trench 220. In order to further control the flow of the fluid in the sample analyzing volume 500, first rigid layer 20 may be provided with one or two side cavities located in direction of flow. All dimensions disclosed for the input trench may, but do not need to be applied to these other cavities.

Figure 13:
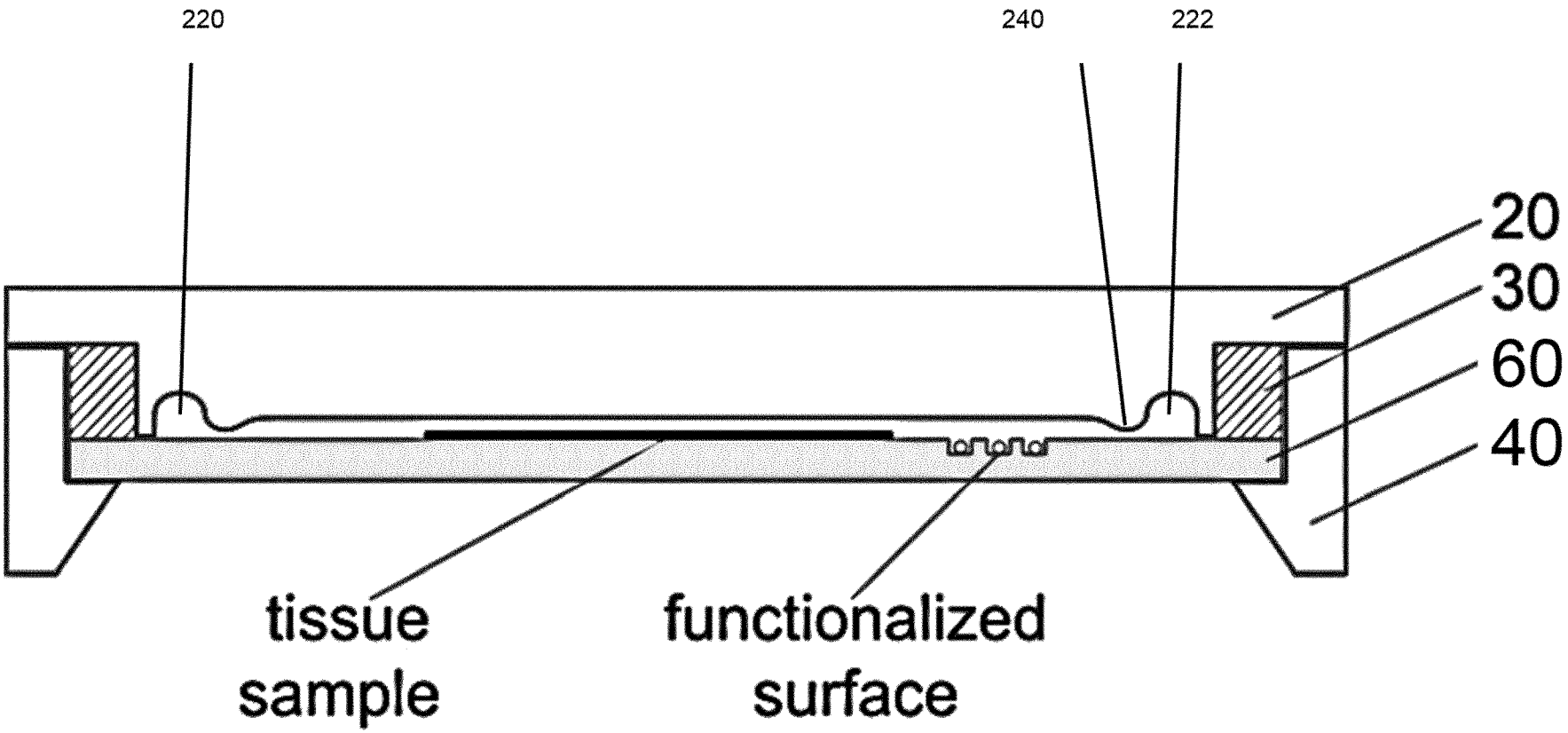
FIG. 13 is a schematic view of a multilevel disposable cartridge with a functionalized surface.

In order to control impedance of the flow through the sample analyzing volume 500, the first rigid layer 20 may further comprise a barrier (240) adjacent to at least one side of the analyzing volume (500), which protrudes into the sample analyzing volume (500), such that the fluid flows between the barrier 240 and the specimen support 60 into the sample analyzing volume (500). The barrier 240 is shown in FIGS. 12B and 13 in greater detail. The barrier 240 may have a height h3 of about 200 microns. The barrier 240 may assure that the input trench 220 fills completely during flooding of the sample analyzing volume 500. This may allow uniform contact of the sample with the fluid.

The second rigid layer 40 may hold the specimen support 60 at a level that the sample analyzing volume (500) has a height h1 with respect to the depression or analyzing area 24 of the first layer 20. To ensure uniform flow and good contact of the sample with the fluid, the biological sample may be at a height of h4 with respect to the specimen support 60. Therefore, when the cartridge is assembled, the sample analyzing chamber (500) may have a height h1, the trench (220, 222) a depth h2, the rim or barrier (240) a depth h3 and the biological specimen a height h4, wherein h1, h2, h3 and h4 have ratios of (0.05 to 0.5)×h3=h4 and/or (0.1 to 0.5)×h2=h1 and/or (0.1 to 0.5)×h1=h4. The dimensions are shown schematically in FIG. 12C.

FIG. 13 is a schematic illustration of a further embodiment of the multistage disposable cartridge 1. In this embodiment, the surface of the specimen support 60 is coated with certain biologically active compounds which may interact with the biological specimen. These compounds may be immobilized on the surface of the glass slide in certain areas, rendering the surface, "functionalized". Each functionalized, segmented area may have affixed a biologically active structure which then interacts with the sample, as in an antigen/antibody interaction. Such structures may include antigen recognizing moieties having detection moieties, antibodies with fluorescent dyes, antibiotics, biological nutrients, toxins, stains, and oxidants, for example. The reagents may be applied as described above.

The multilevel disposable cartridge 1 may be constructed as follows: The plastic components of the multilevel disposable cartridge 1 include a first rigid layer 20, and a second rigid layer 40. These components may be injection molded from polycarbonate, poly styrene, polyethylene and COC, for example. The elastomeric layer 30 may be poly siloxane and may be cut or stamped. These components may then be joined by a glue, by plasma activation of the layers or high frequencies welding. The fine details such as the fluidic/pneumatic channels may be formed by chemical etching or laser removal or as a part of the mold.

In operation, the plurality of fluid wells or reservoirs 22 may each be filled robotically or by hand pipette with a quantity of reagent. A biological sample may then be laid on the specimen support 60 and in the sample analyzing volume 500, along with a quantity of buffer fluid to keep the sample moist. The support 60 may then be snapped into place on multilevel disposable cartridge 1 by clamping structures 45. The multilevel disposable cartridge 1 may then be coupled to sources of pressure and vacuum at input/output ports 42 on the second rigid layer 40. The plurality of fluid reservoirs may contain a plurality of reagents, of which at least one is an antibody conjugated to a fluorescent molecule. A controller or computer (not shown) may then direct the sources of pressure or vacuum to be applied to a particular valve through input/output port 42, and using the array architecture shown in FIG. 11. The sample analyzing chamber 500 may be imaged microscopically by an objective lens positioned above the sample analyzing volume 500, or simply by eye with the aid of a microscope.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. Accordingly, the exemplary implementations set forth above, are intended to be illustrative, not limiting.

What is claimed is:

1. A disposable for analyzing biological specimens, comprising:

a first rigid layer (20), having an analyzing area (24), a plurality of fluid reservoirs (22) and a plurality of fluidic channels formed therein wherein the channels provide fluid communication to the fluid reservoirs;

a flexible layer (30) having a plurality of fluidic control points (33) in fluid communication with at least one of the fluid reservoirs (22); a second rigid layer (40) with a plurality of pneumatic channels formed therein, wherein the channels provide pneumatic communication to the at least one fluid control point; wherein each fluidic control point is pneumatically controllable to cause flow from only one of the plurality of fluid reservoirs (22) into or out of the fluidic channels, wherein each fluidic control point (33) is pneumatically controllable to cause flow from only one of the plurality of fluid reservoirs (22) into or out of the fluidic channels (125) characterized in that the second rigid layer (40) further comprises an attachment mechanism (45) for holding a support (60), wherein the support (60), the rigid layers (40, 20) and the flexible layer (30) define a transparent sample analyzing volume (500) for imaging the biological specimens in the sample analyzing volume, and wherein the first rigid layer (20) further comprises a straight trench (220) adjacent to at least one side of the sample analyzing volume (500), which accepts and distributes fluid flowing from at least one fluidic reservoir (22) over a whole side of the analyzing volume (500) and wherein the fluidic control point (33) comprises a thinned portion (133) of the flexible layer (30), and wherein the straight trench (220) comprises two parallel straight trenches (220) disposed on two sides of the sample analyzing volume (500).

2. The disposable of claim 1, wherein the second rigid layer (40) further comprises an attachment mechanism (45) for holding a support (60), wherein the support (60), the rigid layers (46, 20) and the flexible membrane (30) define a sample analyzing volume (500).

3. The disposable of claim 1, wherein the fluidic control points are pneumatically controlled by suction applied from a pneumatic channel of the second rigid layer against a backside of the flexible layer, wherein the flexible layer is withdrawn from a first stop against a second stop allowing fluid to flow in and out of the-sample analyzing volume (500).

4. The disposable of claim 2, wherein the fluidic control points are pneumatically controlled by suction applied from a pneumatic channel of the second rigid layer against a backside of the flexible layer, wherein the flexible layer rests against a first stop preventing fluid to flow in and out of the sample analyzing volume (500).

5. The disposable of claim 1, wherein the fluidic control points comprise a thinned portion (133) of the flexible layer (30) which is deflected against a first stop (120) and a second stop (43).

6. The disposable of claim 5, wherein the fluid control point comprises a raised feature (120) in the first rigid layer (20) which protrudes into the fluidic channel, and defines first stop (120) for the thinned portion (133) of the flexible layer (30) and an opening in a pneumatic channel of the second rigid layer (40) as second stop (43) for the thinned portion (133) of the flexible layer (30) wherein the thinned portion (133) opens and closes the fluidic channel in the first rigid layer (20).

7. The disposable of claim 5, wherein the second rigid layer (40) comprises a pressure point (43) which protrudes into a cavity of the flexible layer (30) as second stop for the thinned portion (133) of the flexible layer (30).

8. The disposable of claim 7, wherein the pressure point (43) protrudes into the cavity, thereby registering the flexible membrane (30) with respect to the rigid layer (40), at a location adjacent to a button formed on the thinned portion (133) of the flexible layer (30).

9. The disposable of claim 1, wherein the flexible layer (30) further comprises a pumping mechanism (200) actuated by a pneumatic force.

10. The disposable of claim 9, wherein the pumping mechanism (200) comprises a movable part (210) in the flexible layer (30) configured to alter the volume of a fluidic channel, and wherein said movable part (210) is in fluidic communication between a first (100) and a second fluidic control point (300).

11. The disposable of claim 2, wherein the second rigid layer comprises a first pneumatic channel providing suction to a row of fluidic control points, and a second pneumatic channel providing suction to a column of fluidic control points, such that the two pneumatic channels together cause fluid to be dispensed from only a single fluid reservoir at a time.

12. The disposable of claim 1, wherein the first rigid layer further comprises a trench (220) adjacent to at least one side of the sample analyzing volume (500), which accepts and distributes fluid flowing from at least one reservoir over a whole side of the the sample analyzing volume (500).

13. The disposable of claim 12, wherein the trench (220) has an asymmetric cross-section.

14. The disposable of claim 1, wherein the first rigid layer (20) further comprises a barrier (240) adjacent to at least one side of the sample analyzing volume (500), which protrudes into the sample analyzing volume (500), such that the fluid flows between the barrier (240) and the support (60) before entering the sample analyzing volume (500), and wherein the barrier (240) has a height of about 200 microns (h3) relative to a surface of the sample analyzing volume (500).

15. The disposable of claim 11, wherein a sample analyzing volume (500) has a height h1, a cavity has a depth h2, a barrier (240) has a depth and a biological specimen has a height h4 and wherein h1, h2, h3 and h4 have ratios of (0.05 to 0.5)×h3=h4 and/or (0.1 to 0.5)×h2=h1 and/or (0.1 to 0.5)×h1=h4.

16. The disposable of claim 1, wherein the flexible layer (30) seals the first rigid layer (20) against the second rigid layer (40) and/or the second rigid layer (40) against the support (60), and wherein the sample analyzing volume is transparent for light having a wavelength between 200 and 100 nm.

17. The disposable of claim 1, wherein the plurality of fluid reservoirs (22) contain a plurality of reagents, of which at least one is an antibody conjugated to a fluorescent molecule.

* * * * *